US007267805B2

(12) United States Patent
Brück et al.

(10) Patent No.: US 7,267,805 B2
(45) Date of Patent: Sep. 11, 2007

(54) PARTICLE TRAP AND ASSEMBLIES AND EXHAUST TRACTS HAVING THE PARTICLE TRAP

(75) Inventors: Rolf Brück, Bergisch Gladbach (DE); Meike Reizig, Erpel (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 692 days.

(21) Appl. No.: 10/310,265

(22) Filed: Dec. 2, 2002

(65) Prior Publication Data

US 2003/0086837 A1 May 8, 2003

Related U.S. Application Data

(63) Continuation of application No. PCT/EP01/06071, filed on May 29, 2001.

(30) Foreign Application Priority Data

May 30, 2000 (DE) ..... 100 26 696

(51) Int. Cl.
*B01D 50/00* (2006.01)
*B01D 53/34* (2006.01)

(52) U.S. Cl. ..... 422/180; 422/177

(58) Field of Classification Search ..... 422/177, 422/180, 171; 55/DIG. 30, 523; 428/593–594
See application file for complete search history.

(56) References Cited

U.S. PATENT DOCUMENTS

| | | | | |
|---|---|---|---|---|
| 3,954,672 A * | 5/1976 | Somers et al. | 502/80 |
| 4,390,355 A * | 6/1983 | Hammond et al. | 55/523 |
| 4,597,262 A | 7/1986 | Retallick | 60/299 |
| 4,647,435 A | 3/1987 | Nonnenmann | 422/180 |
| 4,665,051 A | 5/1987 | Nonnenmann | 422/180 |
| 4,857,089 A * | 8/1989 | Kitagawa et al. | 422/180 |
| 5,045,403 A | 9/1991 | Maus et al. | 428/593 |
| 5,130,208 A | 7/1992 | Maus et al. | 502/439 |
| 5,290,447 A * | 3/1994 | Lippold | 210/493.1 |
| 5,403,559 A | 4/1995 | Swars | 422/180 |
| 5,746,989 A * | 5/1998 | Murachi et al. | 423/213.7 |
| 6,045,628 A * | 4/2000 | Solntsev et al. | 148/281 |
| 6,190,784 B1 * | 2/2001 | Maus et al. | 428/593 |

(Continued)

FOREIGN PATENT DOCUMENTS

DE 27 38 257 B1 11/1978

(Continued)

*Primary Examiner*—Glenn Caldarola
*Assistant Examiner*—Tom Duong
(74) *Attorney, Agent, or Firm*—Laurence A. Greenberg; Werner H. Stemer; Ralph E. Locher

(57) ABSTRACT

A particle trap, which may be installed in a pipe, e.g. in an exhaust tract of a motor vehicle, is provided for the agglomeration and oxidation of particles in a fluid flow and includes a multiplicity of substantially rectilinear and mutually parallel flow passages having passage walls with structures. The structures generate swirling, calming and/or dead zones in the fluid flow but keep the particle trap open to the fluid flow. Therefore, the particle trap is an open system in which particles can be kept or precipitated out of a fluid by turbulences in the flow and can be held until they undergo oxidation. Assemblies and exhaust tracts having the particle trap are also provided.

21 Claims, 5 Drawing Sheets

U.S. PATENT DOCUMENTS

| | | | | |
|---|---|---|---|---|
| 6,534,021 | B1 * | 3/2003 | Maus | 422/180 |
| 2003/0072694 | A1 * | 4/2003 | Hodgson et al. | 422/180 |
| 2004/0013580 | A1 * | 1/2004 | Bruck et al. | 422/171 |
| 2004/0221572 | A1 * | 11/2004 | Treiber | 60/297 |
| 2005/0005597 | A1 * | 1/2005 | Bruck | 60/297 |
| 2005/0229590 | A1 * | 10/2005 | Bruck et al. | 60/286 |
| 2005/0232830 | A1 * | 10/2005 | Bruck | 422/180 |

FOREIGN PATENT DOCUMENTS

| | | | |
|---|---|---|---|
| DE | 33 41 177 | A1 | 4/1984 |
| DE | 42 06 812 | A1 | 9/1992 |
| DE | 298 21 009 | U1 | 3/1999 |
| DE | 199 38 854 | C1 | 1/2001 |
| EP | 0 035 053 | A1 | 9/1981 |
| EP | 0 244 798 | A1 | 11/1987 |
| EP | 0 298 943 | A3 | 1/1989 |
| WO | 91/01178 | | 2/1991 |
| WO | 91/01807 | | 2/1991 |
| WO | 93/20339 | | 10/1993 |

* cited by examiner

PARTICLE TRAP AND ASSEMBLIES AND EXHAUST TRACTS HAVING THE PARTICLE TRAP

CROSS-REFERENCE TO RELATED APPLICATION

This application is a continuation of copending International Application No. PCT/EP01/06071, filed May 29, 2001, which designated the United States and was not published in English.

BACKGROUND OF THE INVENTION

Field of the Invention

The invention relates to a particle trap for a particle-laden fluid, in particular for exhaust gas from a diesel engine, in which the particle trap may be regenerated by oxidation of the particles and may be fitted into a pipe such as, for example, an exhaust tract of a motor vehicle. The invention also relates to assemblies and exhaust tracts having the particle trap.

A fluid, such as, for example, the exhaust gas from a motor vehicle, contains particles as well as gaseous constituents. Those particles are expelled together with the exhaust gas or, under certain circumstances, accumulate in the exhaust section or tract and/or in a catalytic converter of a motor vehicle. Then, in the event of load changes, they are discharged in the form of a cloud of particles such as, for example, a cloud of soot.

It is customary to use screens (which in some cases are also known as filters) to trap the particles. However, the use of screens entails two significant drawbacks. Firstly, they can become blocked, and secondly they result in an undesirably high pressure drop. Moreover, statutory motor vehicle emission limits have to be observed, and those limits would be exceeded without a reduction in the number of particles. Therefore, there is a need for elements for trapping exhaust-gas particles which overcome the drawbacks of the screens, filters or other systems.

SUMMARY OF THE INVENTION

It is accordingly an object of the invention to provide a particle trap and assemblies and exhaust tracts having the particle trap, which overcome the hereinafore-mentioned disadvantages of the heretofore-known devices of this general type and in which the particle trap is used for a flow of fluid, can be regenerated and is open.

With the foregoing and other objects in view there is provided, in accordance with the invention, a particle trap for the agglomeration and oxidation of particles in a fluid flow, comprising a multiplicity of substantially rectilinear and mutually parallel flow passages having passage walls with structures. The structures generate swirling, calming and/or dead zones in the fluid flow but keep the particle trap at least partially open to the fluid flow. In addition, at least some of the flow passages have at least a partial region with an elevated heat capacity, e.g. as a result of a higher wall thickness, greater number of cells or the like. Therefore, in the event of dynamic load changes with a rapidly rising fluid temperature, the effect of thermophoresis for particles entrained in the fluid occurs to an increased extent in these regions. Moreover, there are various uses of the particle trap in various combinations with further modules.

Tests using mixing elements include metal foils as described, for example, in International Publication No. WO91/01807, corresponding to U.S. Pat. Nos. 5,130,208 and 5,045,403 or International Publication No. WO91/01178, corresponding to U.S. Pat. No. 5,403,559, which have been tested for improved distribution of additives injected into exhaust systems. It has surprisingly proven possible therein to cause particles, such as the soot from a diesel engine, to accumulate on the bare, i.e. uncoated, metal of the foils, where they can then be oxidized.

The particles are presumably thrown onto the inner wall surfaces of the passages as a result of swirling and then adhere to those inner wall surfaces. The swirling is produced by structures on the inner sides of the passages. Those structures generate not only swirling but also calming or dead zones in the flow shadow. Apparently, the particles are, as it were, flushed into the calming and/or dead zones (in a similar manner to gravity separation) and then adhere securely in those zones. A possible metal/soot interaction and/or a fluid/channel wall temperature gradient plays a role in the adhesion of the particles. Considerable agglomeration of the particles in the gas flow or at the walls is also observed.

The term "calming zone" denotes a zone in the passage which has a low flow rate, and the term "dead zone" denotes a zone without any fluid movement.

The particle trap is referred to as "open" by contrast with closed systems because there are no blind flow alleys. In this case, this property can also be used to characterize the particle trap. For example, an openness of 20% means that when viewed in cross section, medium can flow freely through approximately 20% of the area. In the case of a support with 600 cpsi (cells per square inch) and a hydraulic diameter of the passages of approximately 0.8 mm, this would correspond to a surface area of approximately 0.01 $mm^2$.

The particle trap does not become blocked like a conventional filter system, where pores may clog up, since the flow would first entrain those agglomerated particles which can be torn off due to their high air resistance.

In order to produce a particle trap, at least partially structured layers are coated or wound using known methods and are joined, in particular by brazing. The cell density in the particle trap is dependent on the corrugation of the layers. The corrugation of the layers is not necessarily uniform over an entire layer, but rather it is possible for different flows and/or pressure conditions to be produced within the particle trap through which medium flows by suitable production of the layer structure.

The particle trap may be monolithic or composed of a plurality of disks. In other words, it may include one element or a plurality of individual elements connected one behind the other.

It is preferable to use a system with conical passages or a cone-shaped element in order to cover various (dynamic) load situations of the drive system of a motor vehicle. Systems of that type, as described in International Publication No. WO93/20339, corresponding to U.S. Pat. No. 5,506,028, for example, have passages which widen or narrow, so that particularly favorable conditions for trapping particles are formed at some point in the passages, if they are provided with suitable diverting or swirling structures, for any mass throughput.

In this context, the term "conical" denotes both structures in which there is a widening in the diameter as seen in the direction of flow and structures in which there is a reduction in diameter in the direction of flow. Cylindrical honeycomb bodies with passages of which some narrow and some widen, also have favorable properties.

According to one embodiment of the invention, having a plurality of layers which have been wound to form a honeycomb body, a smooth layer lying between two corrugated layers has holes, so that fluid exchange between the passages formed by the winding is possible. As a result, radial flow through the particle trap which is not limited to a 90° diversion is possible. In the embodiment of the smooth layer with holes, the holes preferably come to lie at the outlet of flow guide vanes, so that the flow is passed directly into the holes. As an alternative to the smooth layer with holes, it is also possible to use a different pervious material such as, for example, a fiber material.

The material used for the layers is preferably metal (sheet metal), but may also be a material of inorganic (ceramic, fiber material), organic or metal-organic nature and/or a sintered material, provided that it has a surface to which the particles can adhere without a coating.

In use, the particle trap is subject to considerable temperature fluctuations in a partially oxidizing atmosphere (air), and various oxides, possibly even in the form of acicular or needle-shaped crystals, known as whiskers, form on the surface of the layers, if the latter are made from metal, resulting in a certain surface roughness. The particles in the flow, which in principle behave similarly to molecules, are flushed onto this rough surface by different mechanisms, in particular impacting or interception in a turbulent flow or thermophoresis in a laminar flow, and are held there. The adhesion is brought about substantially by Van der Waals forces.

Although the deposition of the particles takes place on the uncoated metal foil, the possibility that there will also be coated regions of the particle trap is not ruled out. That is because the particle trap may also be formed in part, for example, as a catalyst support or carrier.

The foil thickness of the layers is preferably in the range between 0.02 and 0.2 mm and particularly preferably between 0.05 and 0.08 mm. In regions with an increased heat capacity, it is preferably between 0.65 and 0.11 mm.

In the case of the particle trap with a plurality of wound layers, these layers are preferably formed of identical or different material and have identical or different foil thicknesses.

The particles in the exhaust gas from a diesel engine, which substantially are formed of soot, can be charged and/or polarized by passing them through an electric field, so that they are diverted from their preferred direction of flow (e.g. axial direction of the particle trap parallel to the flow passages). In this way, the likelihood of the particles coming into contact with the walls of the flow passages of the particle trap is increased, since as they flow through the particle trap they now also have a velocity component in a different direction, in particular perpendicular to the preferred direction of flow. This can also be achieved, for example, with a plasma reactor which is connected upstream of the particle trap and ensures that the particles are polarized. It is also particularly advantageous for the particle trap to form at least one pole of the polarization section, in particular if the particle trap at least in part has a positive charge, and negatively electrically polarized particles are thereby actively attracted. In this way, the mechanisms by which the particles are flushed out of the interior of the flow onto the wall (e.g. interception and impacting) are accelerated and reinforced.

If the particle trap is charged, it is advantageous for points which reinforce the charging effect to be disposed on the layers and/or in the structure of the foil which forms the layers. The particles in the fluid can, for example, be passed through a polarization section in order to be charged, and the particles are then polarized. However, the particle trap may also be grounded and remain with a neutral charge, in particular if there are suitable insulations with regard to the points and/or the polarization section.

According to one embodiment, the polarization and/or charging also takes place through the use of photoionization.

According to another embodiment, the particles are charged and/or polarized through the use of a corona discharge.

A further embodiment of the particle trap makes use of the discovery that a temperature difference between the passage wall and the flow serves to increase the migration of the particles onto the passage wall (thermophoresis). A thick passage wall, which therefore has a high heat capacity (for example produced by the corresponding foil thickness of the layer at that location), is accordingly combined with opposite structures (guide structures) which divert the particles onto this wall (for example by generating swirling in the flow). The thick passage wall has a high heat capacity and therefore, during dynamic load changes and as the exhaust-gas temperature rises, maintains a temperature difference between the flow and the passage wall for a longer time than a thin passage wall, and therefore produces the effect of promoting the deposition for a longer time than a thin passage wall. The guide structures are structures for generating swirling, calming and dead zones and effect forced mixing of the flow, so that particle-rich zones in the interior of the flow are moved outward and vice versa. As a result, it is possible for more particles to come into contact with the walls through interception and impacting and these particles then adhere to the walls.

An additional embodiment makes use of the effect of thermophoresis by connecting a plurality of particle traps in series. These traps each have passage walls with different thicknesses.

The cell densities of the particle trap are preferably in the range between 25 and 1000 cpsi. They are preferably between 200 and 400 cpsi.

A typical particle trap with 200 cpsi has a volume, based on a diesel engine, of approximately 0.2 to 1 l/100 kW, preferably 0.4-0.85 l/100 kW. In the case of the geometric surface area, the result is 1.78 $m^2$/100 kW, by way of example. Compared with the volumes of conventional filters and screen systems, this is a very small volume or a very small geometric surface area as compared to a conventional structure which requires approximately 4 $m^2$ of the surface area per 100 kW.

The particle trap can be regenerated. In the case of soot deposition in the diesel engine exhaust section or tract, the regeneration is effected by oxidation of the soot either by nitrogen dioxide ($NO_2$) at a temperature above approximately 200° C. or thermally using air or oxygen ($O_2$) at temperatures of, for example, above 500° C., or by injection of an additive (e.g. cerium).

Oxidation of soot through the use of $NO_2$, for example using the mechanism of the continuous regeneration trap (CRT) in accordance with the following equation:

$$C+2NO_2 \rightarrow CO_2+2NO$$

requires an oxidation catalytic converter, which oxidizes sufficient amounts of NO to form $NO_2$, to be fitted in the exhaust section or tract upstream of the particle trap. However, the quantitative ratio of the reaction partners is also largely dependent on the mixing of the fluids, so that different quantitative ratios also need to be used depending on the configuration of the passages in the particle trap.

In one embodiment, an auxiliary device is provided for thermal regeneration of the particle trap so that, for example, the element can be at least partially electrically heated or an electrically heatable auxiliary device, such as a heating catalytic converter, is connected upstream of the element. That has proven particularly advantageous.

In another configuration, it is provided that an auxiliary device is switched on or off for regeneration depending on the occupancy/filling level of the particle trap. In the simplest case, the level is measured through the use of the pressure loss generated by the particle trap in the exhaust section or tract.

According to a preferred embodiment, an oxidation catalytic converter connected upstream of the particle trap has a lower specific heat capacity per unit volume and number of cells than the particle trap itself. For example, the oxidation catalytic converter preferably has a volume of 0.5 liter, a number of cells of 400 cpsi and a foil thickness of 0.05 mm. The particle trap, for the same volume and the same number of cells, has a foil thickness of 0.08 mm, and a downstream SCR catalytic converter once again has a foil thickness of 0.05 mm.

The combination of the particle trap with at least one catalytic converter and a turbocharger or the combination of a particle trap with a turbocharger is also advantageous. In this case, the particle trap connected downstream of the turbocharger may be disposed close to the engine or in a position in the underbody.

The particle trap is also used in combination with an upstream or downstream soot filter. It is possible for the downstream soot filter to be significantly smaller than the conventional soot filter, since it is merely intended to offer an additional degree of protection to prevent the emission of particles. It is preferable to use a filter with a size of 0.5 $m^2$ per 100 kW of diesel engine up to a maximum size of 1 $m^2$ (in the case of a downstream filter surface, the cross-sectional area of the filter is matched to that of the particle trap, both in the case of a narrowing cross section and in the case of a widening cross section). However, without a particle trap, filter sizes of approximately 4 $m^2$ per 100 kW are required.

The soot filter may also be in the form of filter material which is installed directly upstream or downstream of the storage/oxidation element, in which case the filter material may be directly joined, for example using a brazed or soldered joint, to the storage/oxidation element.

The following examples provide configurations which demonstrate the wide range of possible combinations of the particle trap with catalytic converters, turbochargers, soot filter and addition of additive along an exhaust section or tract of a motor vehicle:

A) Oxidation catalytic converter—turbocharger—particle trap, in which the particle trap may be disposed close to the engine or in an underbody position;
B) Primary catalytic converter—particle trap—turbocharger;
C) Oxidation catalytic converter—turbocharger—oxidation catalytic converter—particle trap;
D) Heating catalytic converter—particle trap 1—particle trap 2 (particle traps 1 and 2 may be identical or different);
E) Particle trap 1—conical opening of the exhaust section or tract—particle trap 2;
F) Addition or feed of additive—particle trap—hydrolysis catalytic converter—reduction catalytic converter; and
G) Primary catalytic converter—oxidation catalytic converter—addition or feed of additive—(optional soot filter) particle trap e.g. in conical form, if appropriate with hydrolysis coating—(optional soot filter)—(optional cone for increasing the pipe cross section)—reduction catalytic converter.

According to one embodiment, the particle trap is used in combination with at least one catalytic converter. For this purpose, in particular, an oxidation catalytic converter, a heating catalytic converter with an upstream or downstream heating disk, a hydrolysis catalytic converter and/or a reduction catalytic converter are suitable as the catalytic converters, electrocatalytic converters and/or primary catalytic converters. The oxidation catalytic converters being used may also be those which oxidize $NO_x$ (nitrous gases) to form nitrogen dioxide ($NO_2$), in addition to those which oxidize hydrocarbons and carbon monoxide to form carbon dioxide. The catalytic converters are, for example, tubular or conical.

It is preferable for a nitrogen dioxide ($NO_2$) storage device or accumulator to be inserted upstream of the particle trap which, when required, provides sufficient quantities of $N0_2$ for the oxidation of the soot in the particle trap. This storage device or accumulator may, for example, be an activated carbon storage device or accumulator, for example with a sufficient supply of oxygen.

Depending on the particular embodiment, the particle trap may have different coatings in partial regions. These coatings each produce a certain functionality. By way of example, the particle trap, in addition to its function as a trap for particles, may also have a storage, mixing, oxidation or flow-distribution function and may also, for example, serve the function of acting as a hydrolysis catalytic converter.

The use of a particle trap makes it possible to achieve separation rates of up to 90%.

It has been established that the deposition of particles takes place in particular at the inlet and outlet surfaces of the catalytic converters. Therefore, according to one embodiment, the particle trap is used not in the form of one element but rather in the form of a plurality of narrow elements which are connected one behind the other, as a multidisk element. It is also possible to use particle traps which include corrugated layers without structures to generate swirling and calming zones and with a coating (i.e. for example conventional catalytic converters). It is preferable to use up to 10 elements. This structure, which is described as a "disk configuration" or "disk catalytic converter", can be used, for example, if particle deposition in the range from 10 to 20% (when using conventional catalytic converters) is desired.

The present invention proposes a particle trap which can replace conventional filter and screen systems and has significant advantages over those systems:

Firstly, it cannot become blocked, and the pressure drop produced by the system does not increase as quickly over the course of the operating period as it does in screens, since the particles adhere outside the fluid flow. Secondly, it results in relatively low pressure losses, since it is an open system.

Other features which are considered as characteristic for the invention are set forth in the appended claims.

Although the invention is illustrated and described herein as embodied in a particle trap and assemblies and exhaust tracts having the particle trap, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
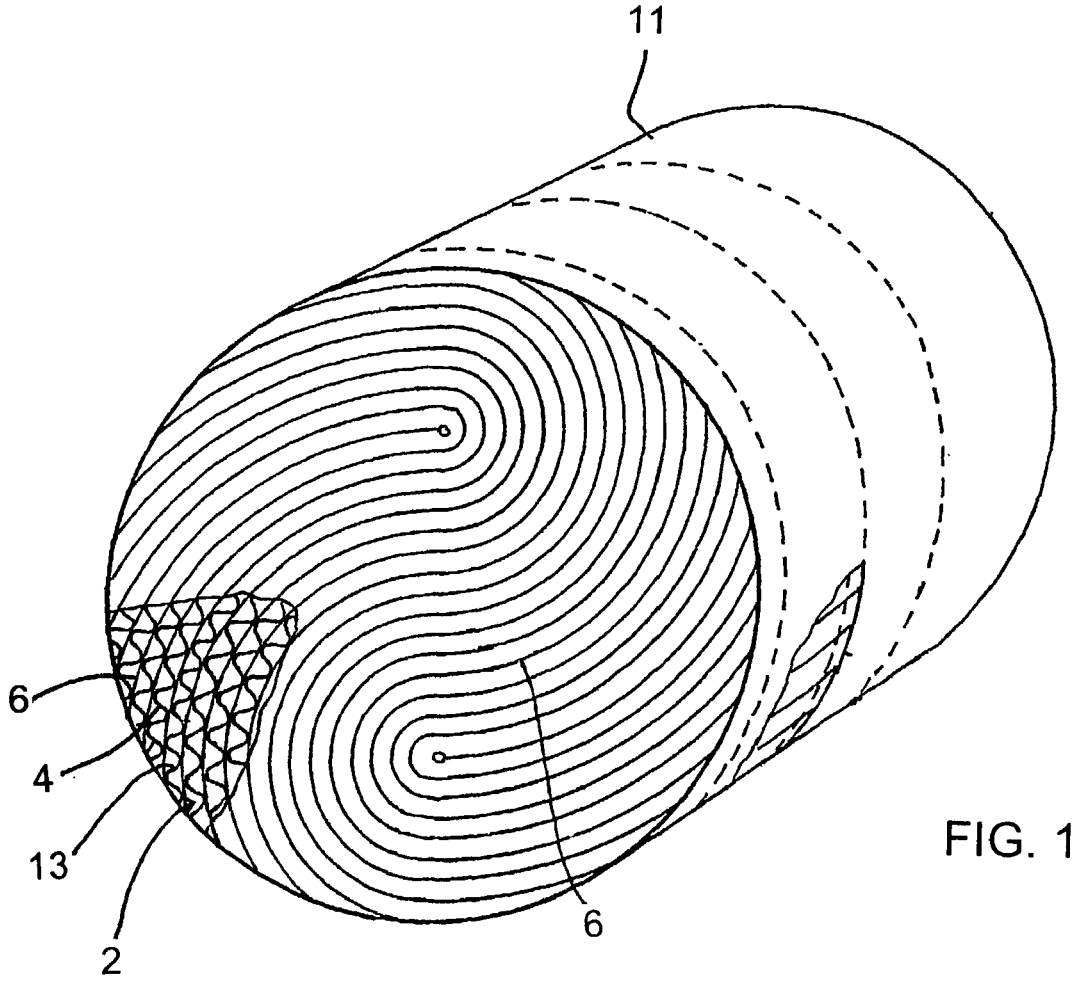
FIG. 1 is a diagrammatic, partly broken-away, perspective view of a particle trap according to the invention in the form of a honeycomb body which has a layered structure.

Referring now to the figures of the drawings in detail and first, particularly, to FIG. 1 thereof, there is seen a particle trap 11 according to the invention which is composed of metallic layers 4, 6 and has flow passages 2 through which a fluid can flow. The flow passages 2 have passage walls 13. The layers 4, 6 are constructed either as corrugated layers 4 or as smooth layers 6. The foil thickness of the layers 4, 6 is preferably in the range between 0.02 and 0.2 mm, in particular less than 0.05 mm.

Figure 2:
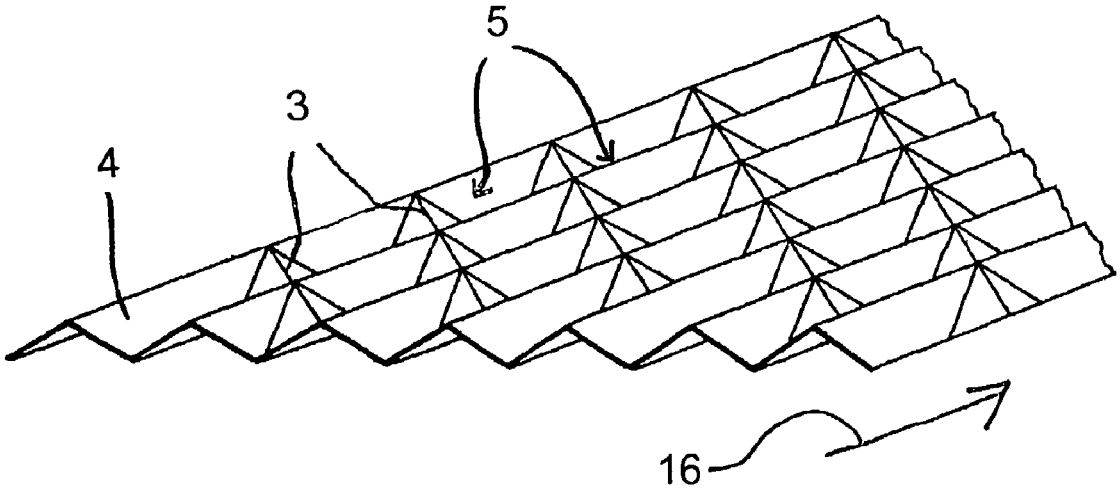
FIG. 2 is a fragmentary, perspective view of an individual layer with structures for generating swirling, calming and/or dead zones.

FIG. 2 diagrammatically depicts a detailed view of the corrugated layer 4, which has structures 3 for generating swirling, calming and/or dead zones 5. Fluid flows along a preferred direction of flow indicated by an arrow 16.

Figure 3:
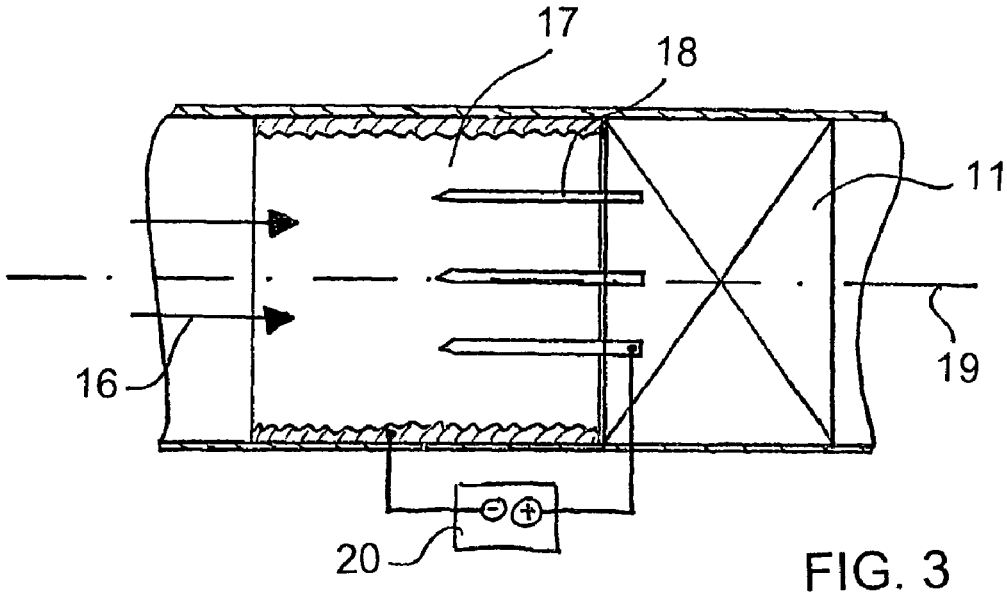
FIG. 3 is a fragmentary, sectional view of a further embodiment of the particle trap according to the invention with a plasma reactor.

FIG. 3 shows a further embodiment of the particle trap 11 according to the invention with a plasma reactor 17 connected upstream thereof. The fluid or the particles which are contained therein is or are at least polarized, possibly even ionized, by the plasma reactor 17 when the fluid flows through the plasma reactor 17 in the preferred direction of flow indicated by the arrow 16. The plasma reactor 17 is connected to a negative pole of a voltage source 20. A positive pole of the voltage source 20 is connected to points 18 of the particle trap 11 which are disposed as close as possible to an axis 19, so that the particles are diverted toward a central region of the particle trap 11 due to Van der Waals forces. An electrostatic field which is formed can be operated with a voltage of 3 to 9 kV. The points 18 may be electrically conductively connected to the metallic layers of the particle trap 11.

Figure 4:
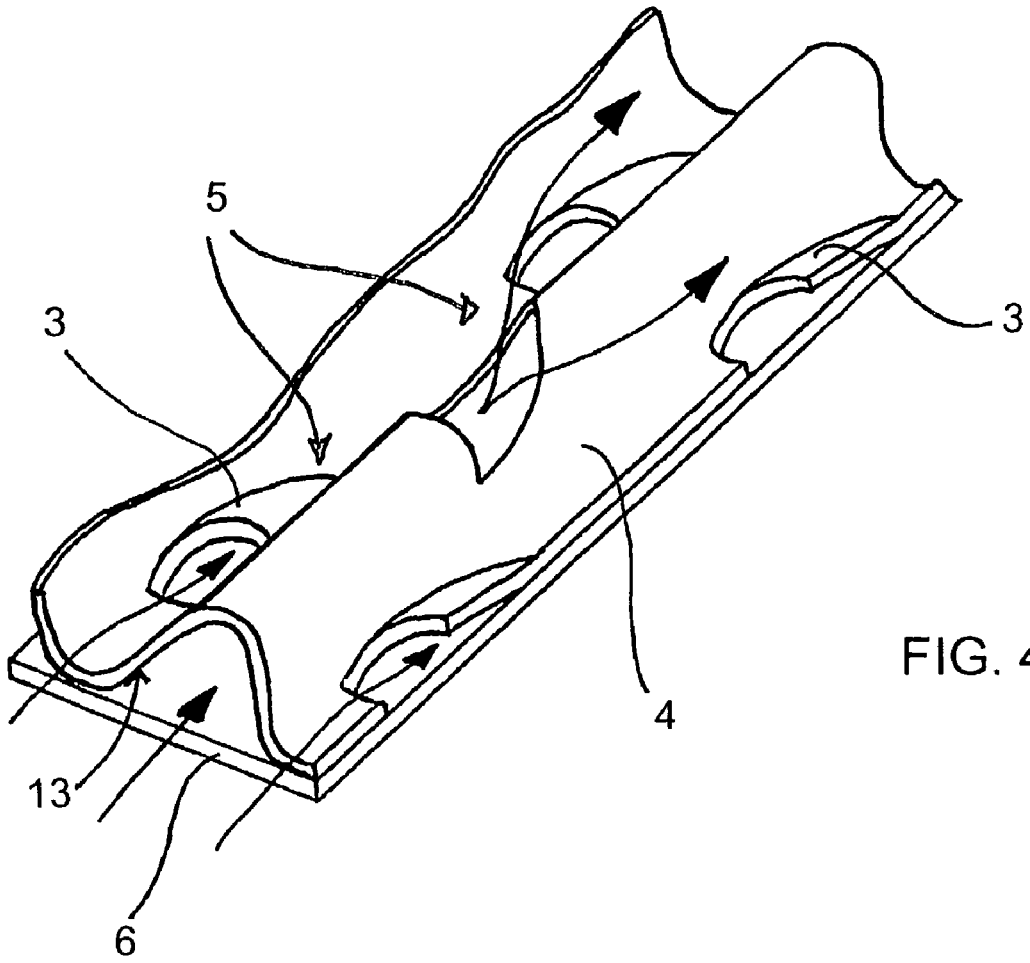
FIG. 4 is a fragmentary, perspective view of a further configuration of the structures used to generate swirling, calming and/or dead zones.

FIG. 4 shows an alternative embodiment of the corrugated layers 4.

Figure 5:
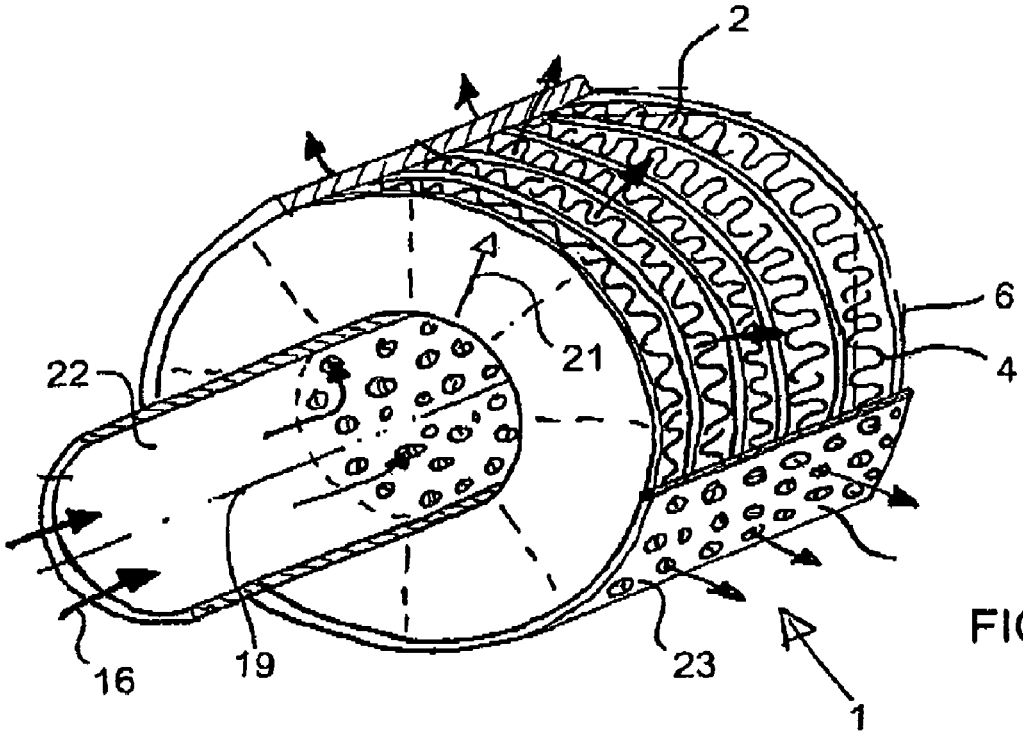
FIG. 5 is a fragmentary, perspective view of a particle trap according to the invention through which medium can flow in the radial direction.

FIG. 5 shows a particle trap through which medium can flow in the direction of the arrow 16 and in a radial direction indicated by a radius 21. The flow passages 2 extend from a central passage 22, which is constructed to be porous in the region of a honeycomb body 1, radially outwardly to a porous casing 23 which surrounds the honeycomb body 1. The honeycomb body 1 is formed from segmented or annular smooth layers 6 and corrugated layers 4.

Figure 6:
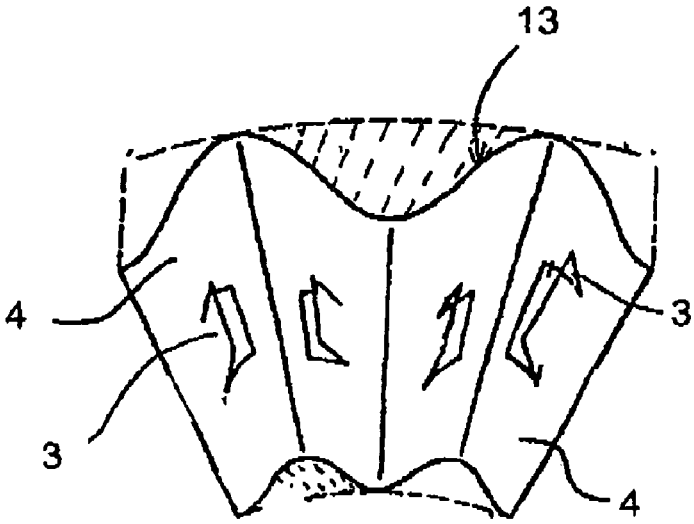
FIG. 6 is a fragmentary, perspective view of a layer with structures for generating swirling, calming and/or dead zones in accordance with FIG. 4.

FIG. 6 shows a possible, segmented embodiment of the corrugated layer 4 with structures 3 for generating swirling, calming and/or dead zones.

Figure 7:
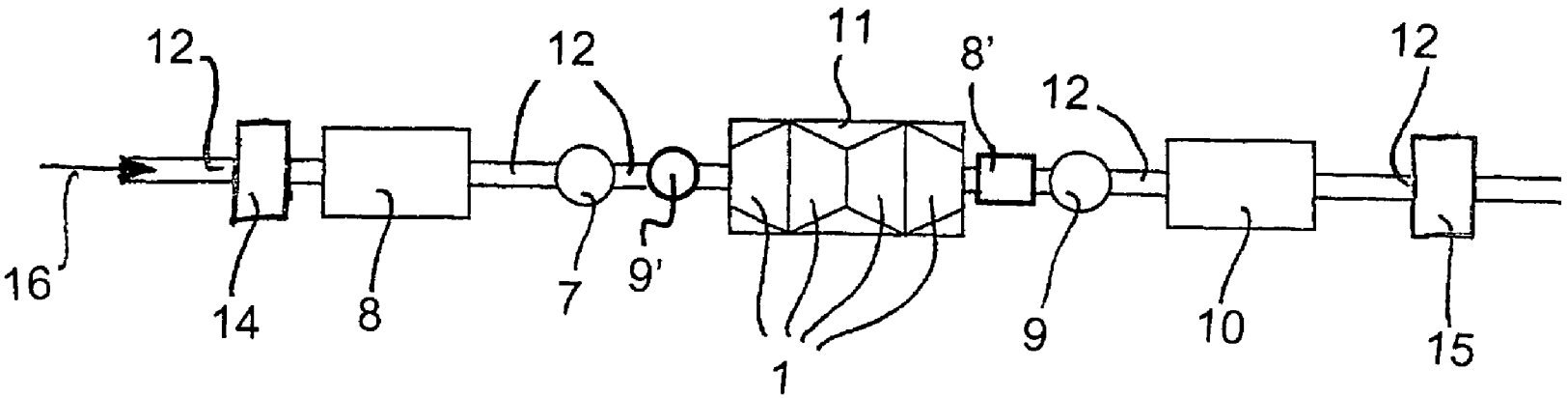
FIG. 7 is a diagrammatic and schematic view of a particle trap in a disk configuration with further exhaust-gas cleaning measures.

FIG. 7 shows a particle trap which has conical passages and includes a plurality of (optionally narrow) elements that are particle traps and/or catalytic converters. In this context, a plurality of honeycomb bodies 1, each of which widen or narrow conically, are disposed one behind the other. An additive feed 7, a nitrogen storage device 14 and an oxidation catalytic converter 8, which is used to oxidize nitrous gases ($NO_x$) to form nitrogen dioxide ($NO_2$), are connected upstream of the honeycomb bodies 1 in an exhaust gas tract 12. A turbocharger 9 and a soot filter 10 are connected downstream. The particle trap 11 is advantageously used in combination with an auxiliary device 15 for soot oxidation. An oxidation catalytic converter 8' and a turbocharger 9' may be provided instead of or in addition to elements 8 and 9 as shown.

We claim:

1. A particle trap for the agglomeration and oxidation of particles in a fluid flow, comprising:

a multiplicity of substantially rectilinear and mutually parallel flow passages having passage walls with structures;

said structures generating at least one of swirling, calming and dead zones in the fluid flow but having no blind flow alleys, for keeping the particle trap open to the fluid flow;

at least some of said flow passages having different heat capacities due to different passage wall thicknesses, and a partial region of said passage walls having a high heat capacity, causing an effect of thermo-phoresis for particles present in the fluid flow to occur to an increased extent in said partial region upon rising fluid temperature.

2. The particle trap according to claim 1, wherein the particle trap is a honeycomb body having a layered structure.

3. The particle trap according to claim 2, wherein said layered structure has only one layer.

4. The particle trap according to claim 2, wherein said layered structure is at least partly formed of metallic layers.

5. The particle trap according to claim 4, wherein said layers have a foil thickness of 0.02 to 0.2 mm.

6. The particle trap according to claim 4, wherein said layers have a foil thickness of between 0.05 and 0.08 mm.

7. The particle trap according to claim 4, wherein said layers are at least partially blank and uncoated.

8. The particle trap according to claim 1, wherein said flow passages form cells having a cell density of 25 to 1000 cpsi.

9. The particle trap according to claim 1, wherein said flow passages form cells having a cell density of 200 and 400 cpsi.

10. The particle trap according to claim 1, wherein said passage walls are formed of metal foils having a foil thickness, and said foil thickness is between 0.65 and 0.11 mm in said partial region of said passage walls of said flow passages having the high heat capacity.

11. The particle trap according to claim 1, which further comprises layers for forming said flow passages, said layers being selected from the group consisting of a corrugated layer and a sznooth layer.

12. The particle trap according to claim 1, wherein said flow passages conduct the fluid flow in radial direction.

13. The particle trap according to claim 1, wherein said flow passages are conical.

14. The particle trap according to claim 1, wherein said flow passages are configured for carrying out the oxidation of particles as soot oxidation.

15. The particle trap according to claim 14, wherein the soot oxidation uses nitrogen dioxide as an oxidizing agent.

16. The particle trap according to claim 1, wherein said passage walls support a catalytically active coating.

17. A particle trap for the agglomeration and oxidation of particles in an exhaust-gas flow from a motor vehicle, comprising:

a multiplicity of substantially rectilinear and mutually parallel exhaust-gas flow passages having passage walls with structures;

said structures generating at least one of swirling, calming and dead zones in the exhaust-gas flow but having no blind flow alleys, for keeping the particle trap open to the exhaust-gas flow;

at least some of said flow passages having different heat capacities due to different passage wall thicknesses, and a partial region of said passage walls having a high heat capacity, causing an effect of thermo-phoresis for particles present in the fluid flow to occur to an increased extent in said partial region upon rising fluid temperature.

18. An assembly for the agglomeration and oxidation of particles in a fluid flow, comprising:

at least one particle trap according to claim 1; and at least one catalytic converter in communication with said at least one particle trap.

19. An assembly for the agglomeration and oxidation of particles in a fluid flow, comprising:

at least one particle trap according to claim 1; and at least one oxidation catalytic converter connected upstream of said at least one particle trap in fluid flow direction, said at least one oxidation catalytic converter including at least one oxidation catalytic converter oxidizing nitrous gases to form nitrogen dioxide.

20. An assembly for the agglomeration and oxidation of particles in a fluid flow, comprising:

at least one particle trap according to claim 1; and at least one oxidation catalytic converter connected downstream of said at least one particle trap in fluid flow direction, said at least one oxidation catalytic converter including at least one oxidation catalytic converter oxidizing nitrous gases to form nitrogen dioxide.

21. An assembly for the agglomeration and oxidation of particles in a fluid flow, comprising:

at least one particle trap according to claim 1;

at least one oxidation catalytic converter connected upstream of said at least one particle trap in fluid flow direction; and at least one oxidation catalytic converter connected downstream of said at least one particle trap;

said oxidation catalytic converters including at least one oxidation catalytic converter oxidizing nitrous gases to form nitrogen dioxide.

* * * * *